United States Patent [19]

Proctor et al.

[11] Patent Number: 4,945,345

[45] Date of Patent: Jul. 31, 1990

[54] CIRCUIT BREAKER SIGNAL

[76] Inventors: Ross Proctor, 162 Fox St., Bridgeport, Conn. 06605; Emilio Ruiz, 1463 Black Rock Turnpike No. 11, Fairfield, Conn. 06430

[21] Appl. No.: 390,803

[22] Filed: Aug. 8, 1989

[51] Int. Cl.[5] ..... G08B 21/00

[52] U.S. Cl. ..... 340/638; 340/639; 335/17

[58] Field of Search ..... 340/638, 639, 644; 335/17; 200/308, 310

[56] References Cited

U.S. PATENT DOCUMENTS 2,405,929 8/1946 Wald ..... 340/639

4,071,749 1/1978 Balogh ..... 315/86 X 4,518,957 5/1985 Wheller ..... 340/638 X 4,698,621 10/1987 Masot ..... 340/638 X

*Primary Examiner*—Joseph A. Orsino, Jr.

*Assistant Examiner*—Jeffery A. Hofsass

*Attorney, Agent, or Firm*—Blum Kaplan

[57] ABSTRACT

A circuit breaker signal for use with a circuit breaker having a switch lever assembly has a housing. An LED associated with each respective circuit breaker is mounted on the housing. A switch extending from the housing comes in contact with the switch lever assembly when the circuit breaker has been activated and activates the associated LED.

9 Claims, 5 Drawing Sheets

FIG. 1
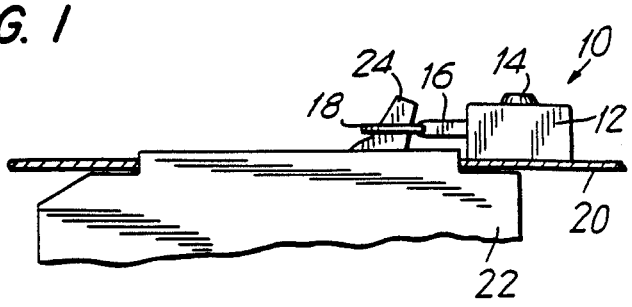
FIG. 2
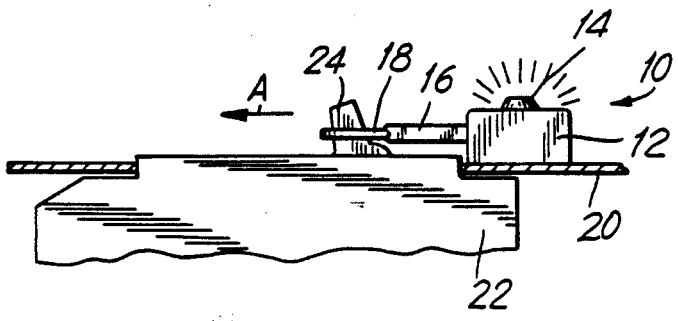
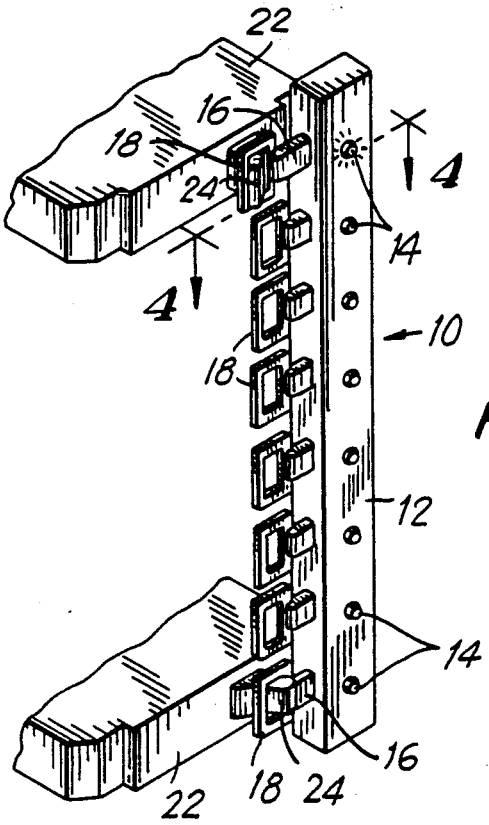
FIG. 3

FIG. 7
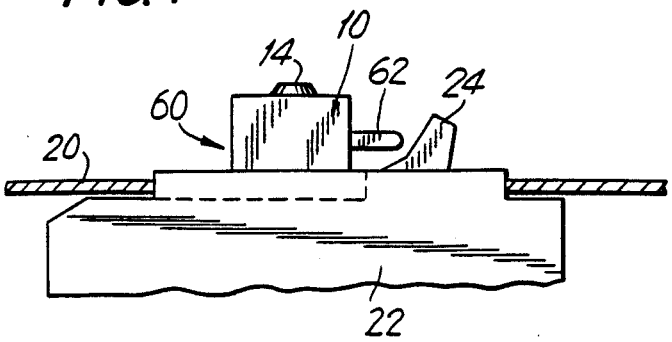
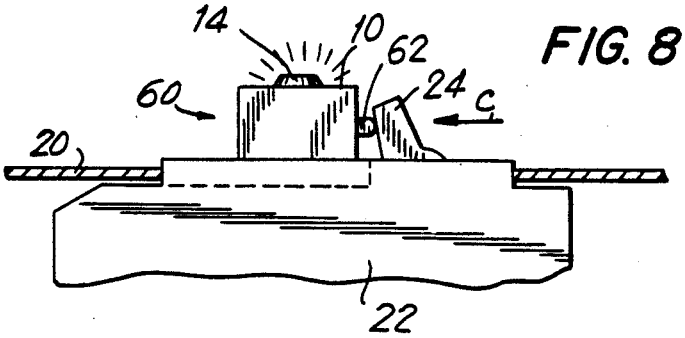
FIG. 8
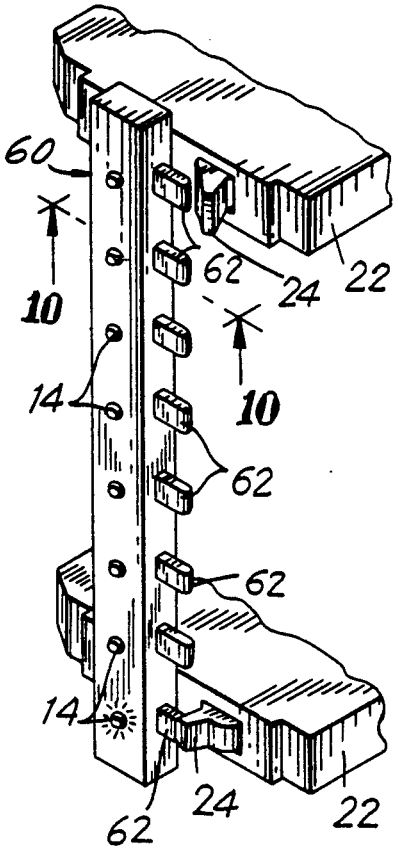
FIG. 9

FIG. 10
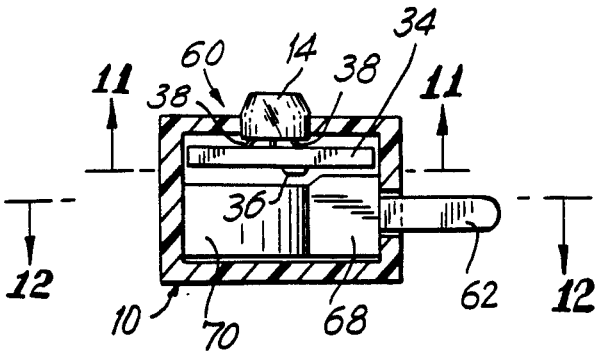
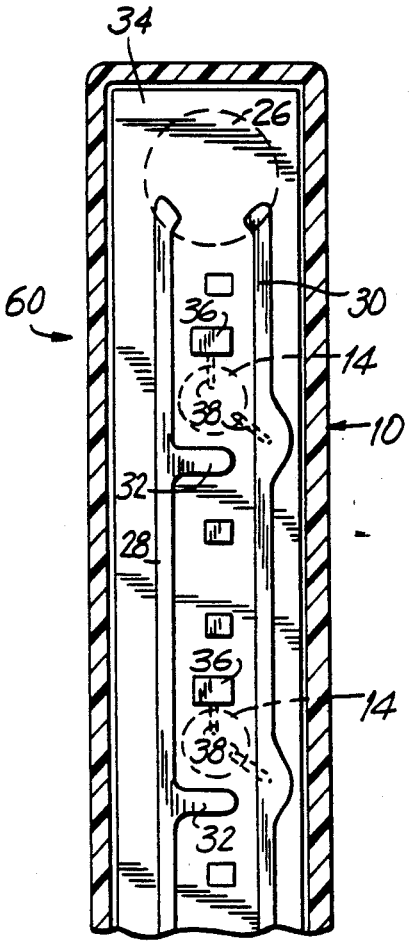
FIG. 11
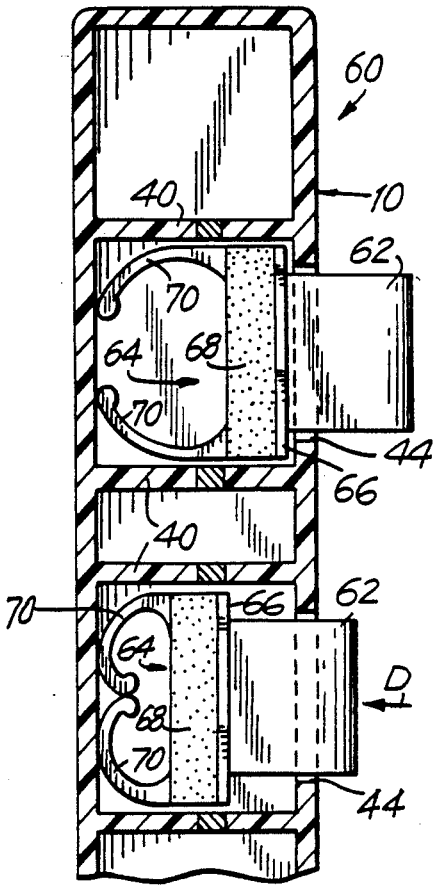
FIG. 12

CIRCUIT BREAKER SIGNAL

BACKGROUND OF THE INVENTION

The present invention relates to overload circuit signals for circuit breakers, and more particularly, to overload circuit signals which are portable and are activated independent of the internal circuitry of the circuit breaker.

Overload circuit breaker signals are known in the prior art as shown in U.S. Pat. No. 3,683,350 which discloses an electrical circuit breaker having an illuminating trip indicator. An illuminating lamp is secured to the cover of the circuit box. The depressible operating button is placed within the circuit breaker box and connected to the line side of the circuit breaker. A depressible operating button is positioned within the circuit breaker box to indicate when the circuit has been tripped. The button is depressed by an intermediate lever contained within the circuit box. When the switch is closed, a circuit is completed between the lamp and a line terminal of the circuit box to indicate that a circuit breaker has been thrown.

Another circuit breaker signal is known from U.S. Pat. No. 4,633,240. It contains a light emitting diode (LED) placed internally within the circuit breaker switch. A switch for activating the LED is also located within the circuit breaker lever. The switch is activated by movement of the circuit breaker lever switch causing the switch contacts of the circuit breaker signal to come in contact with each other and illuminating the LED when the circuit breaker has been tripped.

Another circuit breaker signal is known from U.S. Pat. No. 4,652,867 which includes an activating circuit internal to the circuit breaker and placed in parallel to the circuit breaker. The light emitting diode is triggered to indicate when the circuit breaker has been tripped.

Each of these prior art circuit breaker signals requires that the indicating light be interconnected with a circuit internal to the circuit breaker box. Accordingly, such circuit breaker signals are limited to utilizing complex structures specific to each circuit box to identify the tripped circuit breaker. This increases the complexity of manufacture of such circuit breaker signals as well as installation of the circuit breaker signal for individual circuit boxes. Additionally, as each circuit breaker must be integrated to the internal structure of the circuit breaker, the adaptability and portability of the circuit breaker signals to other circuit breaker signals is extremely limited.

A circuit breaker signal which is not interconnected with the internal circuitry of the circuit breaker box is known in the prior art from U.S. Pat. No. 4,611,201 which includes a magnet placed on the top of the circuit switch lever. A magnet switch is placed adjacent to the lever and opens or closes when the magnet moves in response to the tripping and resetting of the circuit. The movement of the lever causes the switch to activate a light, indicating that the lever has moved.

This device requires that a magnetic switch must be accurately aligned relative to the magnet to effect proper detection. Additionally, adaptability of such a circuit breaker signal is limited in that the magnet must be manufactured to fit each different model circuit breaker switch. Additionally, unless the magnet is permanently affixed to the circuit breaker switch, it may be inadvertently knocked off or fall off curtailing the effectiveness of such a circuit breaker switch. Additionally, assembly of such a switch would still necessitate adding additional structure to the circuit breaker switch itself.

Accordingly, a circuit breaker signal which is more adaptable to a plurality of different circuit breaker boxes and more easily usable with a plurality of circuit breakers through the independence of the circuit breaker signal from any interconnection with the circuit box is desired.

SUMMARY OF THE INVENTION

Generally speaking, in accordance with the invention, a circuit breaker signal for use with at least one switch assembly type circuit breaker is provided. The device includes a housing mounted externally of the circuit breaker box to which it is to be mounted. A plurality of lamps corresponding to a respective circuit breaker are positioned on the housing to indicate when a circuit breaker has been activated and to indicate which circuit breaker has been activated. A switch extending from the housing comes in physical contact with the switch assembly of the circuit breaker when the circuit breaker is activated and causes the light to indicate activation of the particular circuit breaker.

Accordingly, it is an object of the invention to provide an improved circuit breaker signal.

Another object of the invention is to provide a circuit breaker signal which does not require interconnections with the circuit box in order to operate.

A further object of the invention is to provide a portable circuit breaker signaling device.

Yet another object of the invention is to provide a circuit breaker signal which is adaptable to a great variety of circuit breakers.

Still other objects and advantages of the invention will in part be obvious and will in part be apparent from the specification. The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is the side elevational view of a circuit breaker signal constructed in accordance with the invention;

FIG. 2 is a side elevational view of the circuit breaker signal in the activated mode;

FIG. 3 is a partial perspective view of the circuit breaker signal mounted on a circuit breaker panel in accordance with the invention;

FIG. 7 is a side elevational view of a circuit breaker signal constructed in accordance with of a second embodiment of the invention;

FIG. 8 is a side elevational view of the circuit signal breaker in the activated condition;

FIG. 9 is a perspective view of the circuit breaker signal mounted on a circuit breaker panel constructed in accordance with the second embodiment of the invention;

FIG. 10 is an enlarged sectional view taken along line 10—10 of FIG. 9;

FIG. 11 is a sectional view taken along line 11—11 of FIG. 10;

FIG. 12 is a sectional view taken along line 12—12 of FIG. 10;

DETAILED DESCRIPTION OF THE PREFERRED EMBODIMENTS

Figure 4:
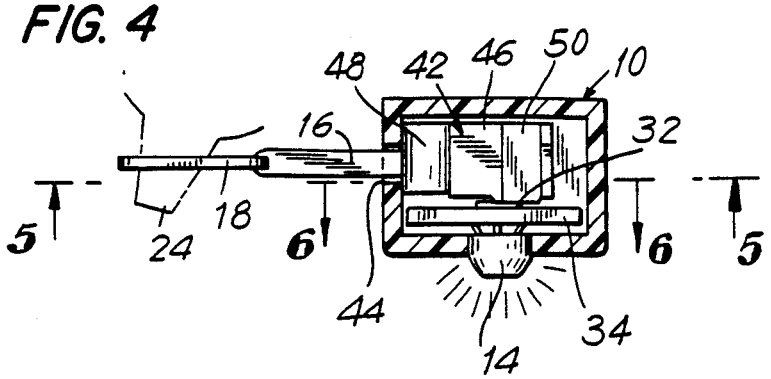
FIG. 4 is an enlarged sectional view taken along line 4—4 of FIG. 3.

Reference is first made to FIGS. 1-3 of the drawings wherein a circuit breaker signal, generally indicated at 10, constructed in accordance with the present invention, is depicted. Circuit breaker signal 10 includes a housing 12 having light emitting diode ("LED") positioned thereon. A strap 16 extends from within the housing. A loop 18 is formed at the end of the strap.

A circuit breaker box is formed with a plurality of circuit breakers 22. Each circuit breaker 22 includes a switch assembly lever 24 extending therefrom. Switch assembly lever 24 moves in the direction of arrow A when the circuit breaker has been activated, i.e. when the circuit has been tripped. A circuit box panel 20 is provided at the front of circuit breakers 22 to form the front face of a circuit box.

Each circuit box may include a number of circuit breakers 22 (not all shown in FIG. 4 along with the circuit box panel for simplicity). Housing 10 is provided with a plurality of LED's 14 corresponding to a respective switch assembly lever 24 of each circuit breaker 22 contained within a circuit box panel. Additionally, a respective loop 18 and strap 16 is provided on housing 12 for each respective switch assembly lever 24.

Housing 12 is mounted by an adhesive on circuit box panel 20 adjacent circuit breakers 22. Each loop 18 is positioned over respective switch assembly lever 24 when circuit breaker 22 is in the non-trip position. When circuit breaker 22 becomes activated, switch assembly lever 24 moves in the direction of arrow E pulling on loop 18, causing loop 18 to be pulled away from housing 12. This closes a switch, to be described in greater detail below, within housing 12 causing LED 14 associated with the circuit breaker 22 which has been tripped to become illuminated, indicating which circuit breaker has been tripped. LED 14 is only illuminated when a circuit breaker 22 associated with that LED 14 and loop 18 moves in the direction of arrow A. Accordingly, which circuit breaker 22 has been activated is easily determined utilizing a simple structure which is independent of the circuitry of the circuit breaker.

Figure 5:
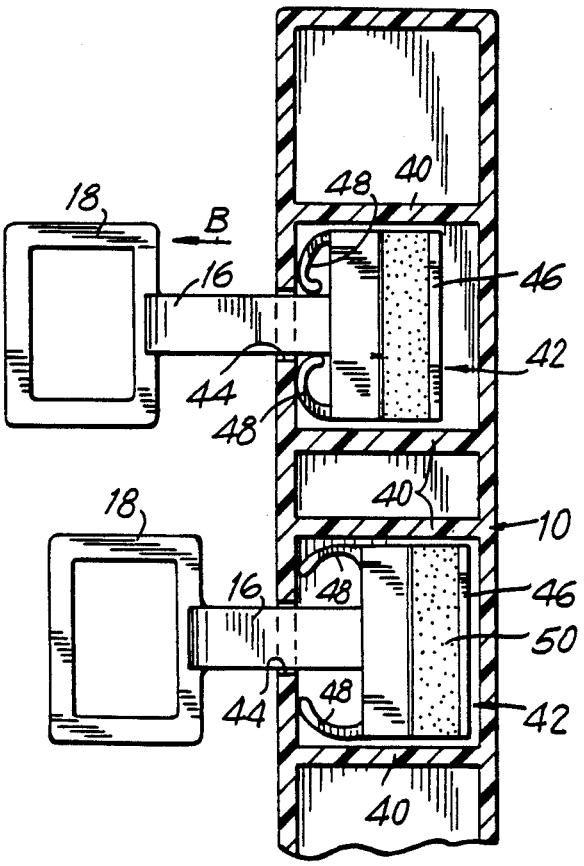
FIG. 5 is a sectional view taken along line 5—5 of FIG. 4.
Figure 6:
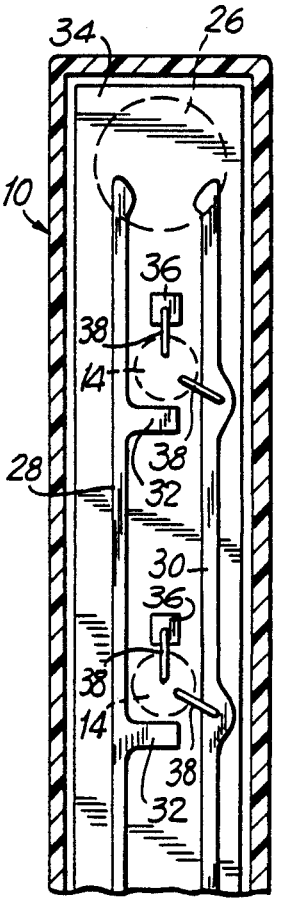
FIG. 6 is a sectional view taken along line 6—6 of FIG. 4.

Reference is now made to FIGS. 4-6 in which the circuitry within housing 10 for illuminating LED 14 is shown. A printed circuit board 34 is mounted within housing 10. A battery 26 is mounted on circuit board 34. A first lead 28 and a second lead 30 extend from battery 26 forming an open circuit. Lead projections 32 extend from first lead 28. As seen in FIGS. 4 and 6, each LED 14 is positioned adjacent a respective lead projection 32 on the opposed side of circuit board 34. LED 14 is electrically coupled between second lead 30 and a diode terminal 36 by diode leads 38 extending through circuit board 34. In an exemplary embodiment, battery 26 is a CAD battery.

As shown in FIG. 5, the top portion of housing 10 is formed into compartments by interior walls 40. Interior walls 40 are positioned within housing 10 to provide an area which overlaps an individual diode 14. A sliding switch, generally indicated at 42, is provided within each compartment formed between walls 40. Each strap 16 extends through an opening 44 within housing 10 to couple loop 18 to sliding switch 42. Sliding switch 42 is formed as a plastic molded piece having a body 46 and springs 48 extending from body 46. An electrically conducting strip 50 extends along the length of body 46 and a portion of the width of body 46 so that a portion of sliding switch 42 is conductive although the remaining portion of sliding switch 42 is formed of a non-conductive plastic material. As seen in FIG. 4, sliding switch 42 is positioned to slide above a respective diode terminal 36 and projection 32 positioned on printed circuit board 34.

When circuit breaker 22 is in the non-activated position, springs 48 positions sliding switch 42 relative to printed circuit board 34 so that lead projection 32 and diode terminal 36 both contact the non-conductive portion of sliding switch 42 maintaining the open circuit. When a pulling force is applied to loop 18, such as when switch assembly lever 24 moves in the direction of arrow A when circuit breaker 22 becomes activated, springs 48 curl upon themselves due to the force applied by springs 48 against housing 10. This allows sliding switch 42 to move in the direction of arrow B causing conducting strip 50 to slide into position to provide a conductive contact between lead projection 32 and diode terminal 36. This closes the circuit from battery 26 to first 28 through conductive strip 50 through LED 14 and second lead 30 causing LED 14 to light indicating that circuit breaker 22 associated with that particular indicating LED 14 has been activated. Accordingly, the tripped circuit is quickly and easily identified as being tripped. In an exemplary embodiment, strap 16 and loop 18 may be integrally molded with body 46 of sliding switch 42.

Reference is now made to FIGS. 7-9 in which a circuit breaker signal, generally indicated at 60, constructed in accordance with a second embodiment of the invention is provided. Like structures are indicated with like numbers, the difference between embodiments of the circuit breaker signal being the replacement of a pull switch with a push switch.

Circuit breaker signal 60 has a house 10 having LED 14 mounted thereon. A push button 62 associated with LED 14 extends from housing 10 in the direction of switch lever assembly 24.

Housing 10 is mounted on circuit box panel 20 adjacent circuit breaker 22. Housing 10 is positioned in the direction of arrow C so that when assembly switch lever 24 moves in the direction of arrow C when circuit breaker 22 becomes activated, switch assembly lever 24 depresses push button 62 causing the associated LED 14 to light indicating that a circuit breaker has been tripped and which circuit breaker has been tripped.

Reference is now made to FIG. 10-12 in which a sectional view of circuit breaker signal 60 is provided. Again, like numerals are utilized to indicate like structure.

A printed circuit board 34 is provided within housing 10. An open circuit is formed between battery 26, first lead 28 and second lead 30. A plurality of lead projections 32 are provided along first lead 28. LED 14 is positioned adjacent each projection lead 32 between a diode terminal 36 and second lead 30. A push button sliding switch 64 is positioned within compartments of housing 12 formed by walls 40. Sliding switch 64 is formed of a molded plastic body 66 having springs 70 extending from body 66 and push button 62 integrally formed within body 66 and extending from housing 2 through opening 44. A conductive strip 64 is mounted within body 66 and extends along the length of body 66. Sliding switch 64 slides across circuit board 34 when push button 62 is depressed in the direction of arrow D so that conductive strip 68 contacts diode terminal 36 and lead projection 32 closing the circuit formed by battery 26, lead 28, lead projection 32, conductive strip 68, diode terminal 36, LED 14 and second lead 30 causing LED to light indicating which circuit breaker 22 has been tripped. By providing a push button switch which is activated by the switch assembly lever of a circuit breaker coming in contact with the switch when activated, a circuit breaker signal which does not require any connection with the circuit breaker panel or circuit breaker prior to activation of the circuit breaker is provided.

Many times, the circuit breaker which is tripped controls the room lights for the room in which the circuit box is placed. Accordingly, although the circuit breaker is indicated by a small LED, it may be dangerous or impossible to make one's way to the circuit box due to the total darkness caused by the tripped circuit. Therefore, for better use of a circuit breaker signal it becomes necessary to provide an auxiliary light which is activated when a circuit breaker is tripped.

Figure 13:
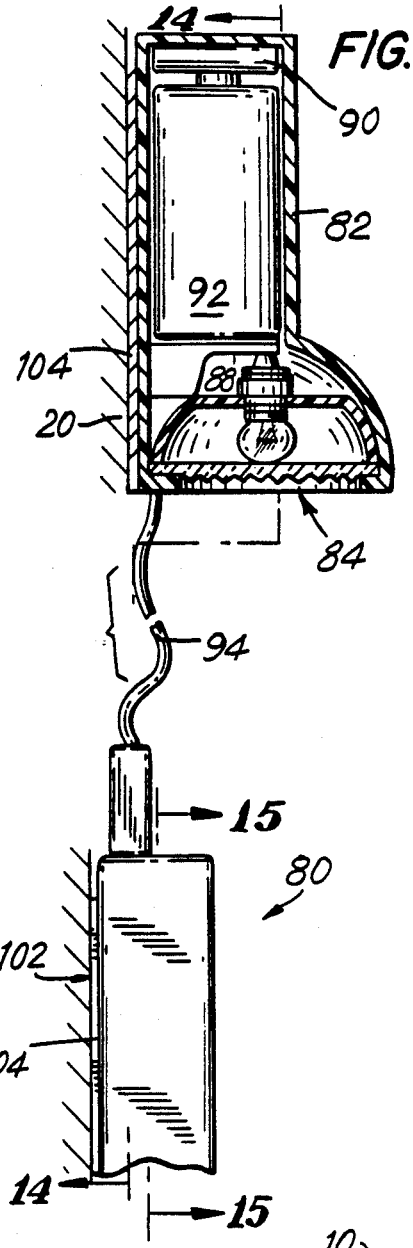
FIG. 13 is a sectional view of a circuit breaker signal device constructed in accordance with a third embodiment of the invention.
Figure 14:
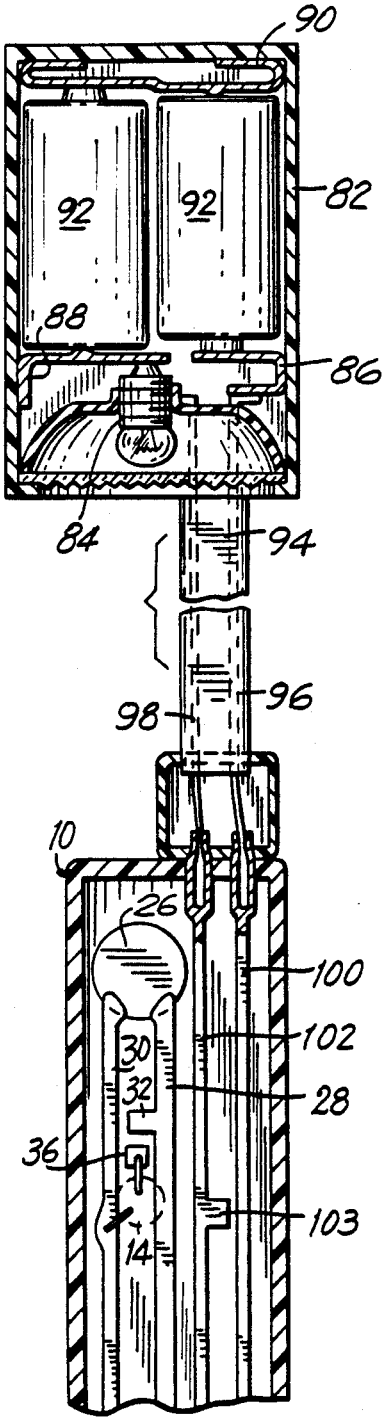
FIG. 14 is a sectional view taken along line 14—14 of FIG. 13.
Figure 15:
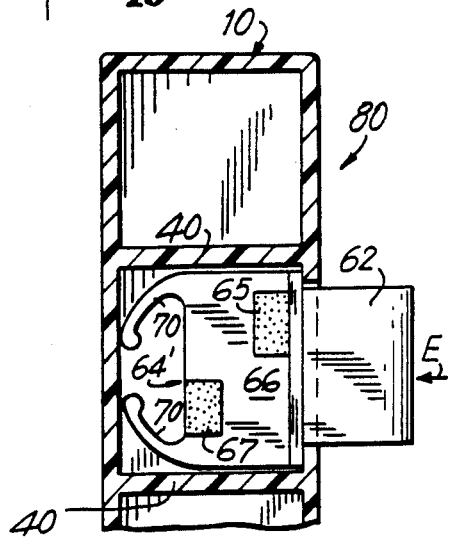
FIG. 15 is a sectional view taken along line 15—15 of FIG. 13.

Reference is now made to FIG. 13–15 in which a third embodiment of a circuit breaker signal, generally indicated at 80, for indicating the tripped circuit breaker as well as providing a light for illuminating the circuit panel is provided. Like numerals are again used for like structure.

Signal circuit breaker 80 includes a first housing 10 and a second housing 82. Housing 82 supports a lamp 84. A second lead 86 is connected to lamp 84. A third lead 88 is also connected to lamp 84 to provide two leads for a lamp lighting circuit. A battery terminal 90 is provided within housing 82 so that batteries 92 may be supported between leads 86, 88 and battery terminal 90. A cable 94 extends from housing 82 to housing 10 and contains therein a first wire 96 extending from first lead 86 and a second wire 98 extending from lamp 84. Within housing 10 is a fifth lead 100 and a sixth lead 102 having lead projections 103 extending therefrom. Lead 102 is electrically connected to wire 98 while lead 100 is electronically connected to wire 96 providing an open circuit between batteries 92, lamp 84 and leads 100, 102. Also within housing 10 is provided the open circuit formed by battery 26, first lead 30, LED 14 and second lead 28.

A switch 64′ is formed of a single molded body 66 having a push button 62 and spring 70. A first conductive region 65 is formed on body 66 a spaced distance from a second conductive region 67. First conductive region 65 is separated by the non-conducting plastic body 66 from conductive region 67 so that there is no electrical interaction between the two. Sliding switch 64′ is positioned to slide across projection 32, diode lead terminal 36 as described above as well as lead projection 103 and leads 100, 102. When push button 62 is depressed in the direction of arrow E by a tripped circuit breaker, sliding switch 64′ is caused to move so that conductive region 65 contacts both lead projection 32 and diode terminal 36 closing the circuit causing LED 14 to light as described above. Simultaneously, conductive region 67 contacts both lead projections 103 and lead 100 causing lamp 84 to light illuminating the circuit board. Housing 82 is attached to the front of circuit panel 20 by means of an adhesive 104.

It will thus be seen that the objects set forth above among those made apparent from the preceding description are efficiently attained and, since certain changes may be made in the above constructions without departing from the spirit and scope of the invention, it is intended that all matter contained in the above description or shown in the accompanied drawings shall be interpreted as illustrative and not in the limiting sense.

It is also to be understood that the following claims are intended to cover all the generic and specific features of the invention herein described and all statements of the scope of the invention which, as a matter language might be said to fall therebetween.

What is claimed is:

1. A circuit breaker signal for use with at least one circuit breaker each circuit breaker having a switch assembly comprising a housing supportable externally of said circuit breaker, indication means coupled to said housing for indicating when a circuit breaker has been activated and indicating which circuit breaker has been activated, and switch means supported on said housing for coming in contact with said switch assembly when the circuit breaker is activated and causing said indication means to indicate activation, said circuit breaker including a switch assembly lever, said switch means including a sliding switch coupled to a loop, the loop being coupled to a switch assembly lever, and causing said sliding switch to slide when said circuit breaker has been activated.

2. A circuit breaker signal for use with at least one circuit breaker each circuit breaker having a switch assembly comprising a housing supportable externally of said circuit breaker, indication means coupled to said housing for indicating when a circuit breaker has been activated and indicating which circuit breaker has been activated, and switch means supported on said housing for coming in contact with said switch assembly when the circuit breaker is activated and causing said indication means to indicate activation, said housing including a printed circuit board having an open circuit therein, a sliding switch being formed with a conductive strip wherein said conductive strip is slid into position to close said open circuit when said circuit breaker has been activated causing said indication means to indicate when said circuit breaker has been activated.

3. The circuit breaker signal of claim 2, wherein said indication means includes an LED associated with said circuit breaker which has been activated.

4. The circuit breaker signal of claim 2, wherein said switch means comprises a sliding switch, said sliding switch being integrally formed with a push button, said push button being depressed when said circuit breaker has been activated.

5. The circuit breaker signal of claim 2, wherein said indication means is an LED, said LED being lit when said conductive strip is slid to close said open circuit.

6. The circuit breaker signal of claim 5, further comprising illumination means for illuminating said circuit breaker when said circuit breaker has been activated.

7. The circuit breaker signal of claim 6, further comprising a second housing mounted externally of said circuit breaker, said illumination means being mounted within said second housing.

8. The circuit breaker signal of claim 2, further comprising illumination means for illuminating said circuit breaker when said circuit breaker has been activated.

9. The circuit breaker signal of claim 8, further comprising a second housing mounted externally of said circuit breaker, said illumination means being mounted within said second housing.

* * * * *